US007728505B2

(12) United States Patent
Liu et al.

(10) Patent No.: US 7,728,505 B2
(45) Date of Patent: Jun. 1, 2010

(54) FIELD EMISSION LUMINESCENT LIGHT SOURCE WITHIN A BULB

(75) Inventors: Peng Liu, Beijing (CN); Yang Wei, Beijing (CN); Lei-Mei Sheng, Beijing (CN); Li Qian, Beijing (CN); Jie Tang, Beijing (CN); Liang Liu, Beijing (CN); Cai-Lin Guo, Beijing (CN); Bing-Chu Du, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 386 days.

(21) Appl. No.: 11/256,727

(22) Filed: Oct. 24, 2005

(65) Prior Publication Data

US 2006/0091782 A1 May 4, 2006

(30) Foreign Application Priority Data

Oct. 29, 2004 (CN) ..... 2004 1 0052036

(51) Int. Cl.
*H01J 1/62* (2006.01)

(52) U.S. Cl. ..... 313/497; 313/310; 313/311; 313/495

(58) Field of Classification Search ..... 313/495–497, 313/309–311
See application file for complete search history.

(56) References Cited

U.S. PATENT DOCUMENTS 5,866,984 A 2/1999 Doughty et al.
5,932,970 A * 8/1999 Chiba et al. ..... 313/623
6,121,728 A * 9/2000 Kikuchihara et al. ..... 313/623
7,193,357 B2 * 3/2007 Choi et al. ..... 313/495
2002/0070648 A1 * 6/2002 Forsberg ..... 313/309
2003/0184213 A1 * 10/2003 Hofmann et al. ..... 313/495

(Continued)

FOREIGN PATENT DOCUMENTS

JP 2003-346707 A 12/2003

OTHER PUBLICATIONS

Mirko Croci, Imad Arfaoui, Thomas Stockli, Andre Chatelain, Jean-Marc Bonard, A Fully Sealed Luminescent Tube Based On Carbon Nanotube Field Emission, Microelectronics Journal, 35 (2004), p. 329-336.

(Continued)

*Primary Examiner*—Bumsuk Won
(74) *Attorney, Agent, or Firm*—D. Austin Bonderer

(57) ABSTRACT

A field emission luminescent lamp includes a bulb (40) being vacuum sealed and defining an inner surface; a lamp head mated with the bulb; an electron emitting cathode filament (20) having a conductive wire (10) and a plurality of electron emitters (12) formed thereon, the electron emitting cathode filament is positioned in the bulb; an anode layer (44) formed on the inner surface of the bulb; a phosphor layer (42) formed on the anode layer; an anode electrode (56) located at the lamp head and electrically connected with the anode layer; and a cathode electrode (54) located at the lamp head and electrically connected with the electron emitting cathode filament. The lamp may further include a gate grid (62) and a gate electrode (54). The gate grid defines a number of grid holes and surrounds the cathode filament. The gate grid is electrically connected with the gate electrode.

20 Claims, 3 Drawing Sheets

U.S. PATENT DOCUMENTS

| | | | | |
|---|---|---|---|---|
| 2004/0061429 | A1* | 4/2004 | Sakai et al. | 313/491 |
| 2005/0212397 | A1* | 9/2005 | Murazaki et al. | 313/487 |
| 2006/0071585 | A1* | 4/2006 | Wang | 313/315 |

OTHER PUBLICATIONS

Jean-Marc Bonard, Thomas Stockli, Oliver Noury Andre Chatelain, Field Emission for Luminescent Cylindrical Carbon Nanotube Cathodes: Possibilities for Luminescent Tubes, Applied Physics Letters, 78 (2001) p. 2775-2777.

S.H. Jo, D.Z. Wang, J.Y. Huang, Field Emission of Carbon Nanotubes Grown On Carbon Cloth, Applied Physics Letters, 85 (2004), p. 810-812.

S.H. Jo, D. Banerjee, Z.F. Ren, Field Emission of Zine Oxide Nanowires Grown On Carbon Cloth, Applied Physics Letters, 85 (2004), p. 1407-1409.

* cited by examiner

FIELD EMISSION LUMINESCENT LIGHT SOURCE WITHIN A BULB

BACKGROUND OF THE INVENTION

1. Field of the Invention

The present invention relates to a mercury-free light source, and more particularly to a cold cathode luminescent field emission device which is environmentally friendly and energy efficient.

2. Related Art

Light sources for daily living are usually incandescent lamps or fluorescent tubes. Incandescent lamps have a long history since the first incandescent lamp invented by Thomas Edison in 1879. However, because an incandescent lamp emits light by incandescence of a tungsten filament, most of electric energy used is converted into heat and wasted. Therefore, a main drawback of the incandescent lamp is low energy efficiency.

A conventional fluorescent tube generally includes a transparent glass tube, a phosphor layer coated on an inner surface of the glass tube, and a certain amount of mercury vapor filled in the glass tube. The mercury vapor in the glass tube is excited by an electrical discharge applied in the glass tube. The excitation of the mercury vapor produces ultraviolet (UV) rays, irradiate the phosphor layer on the inner surface of the glass tube. This causes the phosphor layer to emit visible light. Compared with incandescent lamps, fluorescent tubes are more energy efficient. However, a main drawback of fluorescent tubes is that they contain mercury, which is a toxic substance harmful to human beings and the environment. It is anticipated that fluorescent tubes and other electric devices containing mercury will be forbidden in some regions of the world in the future, such as in the European Union.

Therefore, what is needed is a light source that is mercury-free and energy efficient.

SUMMARY

A first embodiment of the present invention provides a field emission lamp comprising: a bulb being vacuum sealed and having an inner surface; a lamp head mated with the bulb; an electron emitting cathode filament positioned in the bulb, the electron emitting cathode filament comprises a conductive wire and a plurality of electron emitters formed the conductive wire; an anode layer formed on the inner surface of the bulb; a phosphor layer formed on the anode layer; an anode electrode located at the lamp head and electrically connected with the anode layer; and a cathode electrode located at the lamp head and electrically connected with the electron emitting cathode filament.

Preferably, the conductive wire of the electron emitting cathode filament comprises a metallic wire having an outer surface, and the electron emitters are formed on the outer surface.

The bulb has a bulb center, the cathode filament is located at the bulb center.

Preferably, the cathode filament has a desired bent shape.

Even more preferably, the cathode filament is sawtooth-shaped, wavy-shaped, or screw-shaped.

The electron emitters comprise nanotubes, nanowires and nanorods. Preferably, the electron emitters comprise carbon nanotubes.

The lamp further comprises an insulating holder fixed at the lamp head and extending into the inner space of the bulb for supporting the cathode filament. A cathode down-lead wire is embedded in the insulating holder. The cathode down-lead wire has opposite down-lead ends, and the down-lead ends are electrically connected with the cathode filament and the cathode electrode, respectively.

According to a second embodiment, the lamp further comprises a gate grid surrounding the cathode filament, and a gate electrode located at the lamp head, the gate grid being electrically connected with the gate electrode, the gate electrode being electrically insulative from the cathode electrode and the anode electrode.

According to the second embodiment of the present invention, the lamp further comprises an insulating holder fixed at the lamp head and extending into the inner space of the bulb, and a gate down-lead embed in the insulating holder, the gate grid being electrically connected with the gate electrode via the gate down-lead. The gate grid defines a number of grid holes therein.

Other systems, methods, features, and advantages will be or become apparent to one skilled in the art upon examination of the following drawings and detailed description. It is intended that all such additional systems, methods, features, and advantages be included within this description, be within the scope of the present invention, and be protected by the accompanying claims.

DETAILED DESCRIPTION OF THE PREFERRED EMBODIMENTS

Reference will now be made to the drawings to describe preferred embodiments of the present invention in detail.

Figure 1:
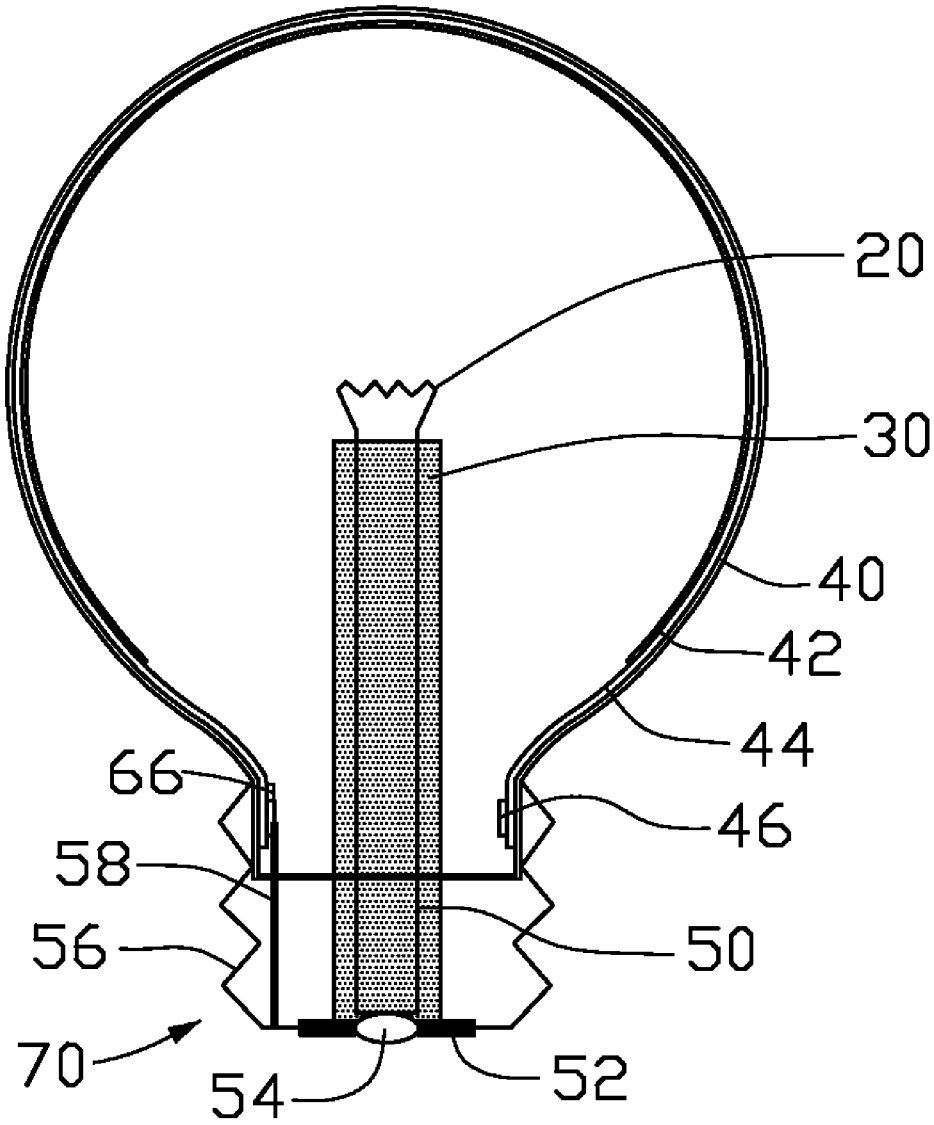
FIG. 1 is a schematic, simplified, cross-sectional view of a fluorescent field emission lamp according to a first preferred embodiment of the present invention.

Referring to FIG. 1, a field emission lamp according to a first preferred embodiment of the present invention includes: a transparent glass bulb 40 used as a light-passable container of the lamp having a main portion (not labeled) and a neck portion (not labeled); a lamp head 70 mated with the neck portion; an anode layer 44 formed on an inner surface (not labeled) of the bulb 40; a phosphor layer 42 formed on the anode layer 44; a cathode electrode 54 and an anode electrode 56 located at the lamp head 70; an anode down-lead ring 46 located at the neck portion of the bulb 40, the anode down-lead ring 46 engaging with the anode layer 44 and electrically connecting with the anode electrode 56 via an anode down-lead pole 58; and a cathode filament-like member 20 positioned in the bulb 40, wherein the cathode filament 20 is electrically connected with the cathode electrode 54 via at least one cathode down-lead wire 50.

The bulb 40 is a hollow member that defines an inner space, the inner space being held in vacuum. The main portion of the bulb 40 can be, for example, spherical or elliptical in cross-section. The lamp head 70 is engaged with the neck portion, thereby sealing the inner space of the bulb 40. The anode layer 44 is a transparent conductive thin film, such as an indium tin oxide (ITO) film. The phosphor layer 42 contains fluorescent material that can emit white or color light when bombarded with electrons. The anode layer 44 covers an inner surface of the main portion of the bulb 40, and an inner surface of the neck portion of the bulb 40. The phosphor layer 42 covers the anode layer 44 at the inner surface of the main portion of the bulb 40. The anode down-lead ring 46 provides an enlarged electrical interface between the anode down-lead pole 58 and the anode layer 44, thereby ensuring reliable electrical contact between the anode layer 44 and the anode down-lead pole 58. An insulating holder 30 is fixed at the lamp head 70 and extends into the inner space of the bulb 40. The insulating holder 30 is for supporting the cathode filament 20. The insulating holder 30 can be, for example, a cylindrical glass pole.

The lamp head 70 is used for sealing the neck portion of the bulb 40, and holding the insulating holder 30 and the cathode filament 20. In the preferred embodiment, the anode electrode 56 is screw-thread shaped, and is located at circumferential side surfaces (not labeled) and a bottom surface (not labeled) of the lamp head 70. It is understood that other shapes are also suitable for the anode electrode 56. Opposite ends of the anode down-lead pole 58 electrically connect with the anode down-lead ring 46 and the anode electrode 56 respectively. Thereby, the anode electrode 56 is electrically connected with the anode layer 44 via the anode down-lead pole 58 and the anode down-lead ring 46. The cathode electrode 54 is located at and protrudes from the bottom surface of the lamp head 70. Furthermore, an electrically insulative medium 52 is formed between the anode electrode 56 and the cathode electrode 54, to insulate the anode electrode 56 from the cathode electrode 54. The insulative medium 52 can be, for example, a piece of glass or ceramic material.

It is noted that the lamp head 70 may be sealed and packed by a glass encapsulation method, and that the lamp head 70 may be filled with glass material or another kind of insulating material.

The cathode filament 20 is used to emit electrons, and is bent, preferably as a wave shape, so as to provide an enlarged surface area for emitting electrons. In the illustrated embodiment, two ends of the cathode filament 20 are connected to the cathode electrode 54 via two cathode down-lead wires 50 respectively. The cathode down-lead wires 50 are embedded in the insulating holder 30. Preferably, the insulating holder 30 extends approximately to a center of the main portion of the bulb 40 so as to locate the cathode filament 20 approximately at the center of the main portion of the bulb 40. This ensures that the cathode filament 20 is subjected to a uniform electrical field produced by the anode layer 44, and can therefore emit electrons uniformly. Preferably, in order to maintain the vacuum of the inner space of the bulb 40, a getter 66 is arranged inside the bulb 40. More preferably, the getter 66 is arranged at the neck portion of the bulb 40. The getter 66 is used to absorb residual gas inside the bulb 40.

Figure 3:
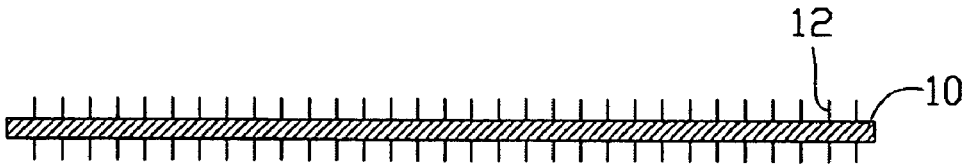
FIG. 3 is an enlarged view of part of a cathode filament according to the first or second preferred embodiments of the present invention.
Figure 4:
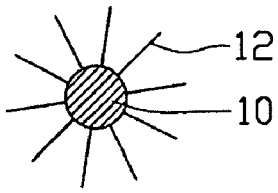
FIG. 4 is an enlarged, end view of the cathode filament shown in FIG. 3.

Referring to FIGS. 3 and 4, the cathode filament 20, which can be bent and used in the above field emission lamp, includes a metallic wire 10 and a number of emitters 12 formed on an outer surface of the metallic wire 10. Preferably, the metallic wire 10 has a small diameter, such as in the order of several tens of micrometers. The emitters 12 can be any one or more of nanotubes, nanowires and nanorods, such as carbon nanotubes, silicon nanowires, zinc oxide nanorods, etc. Carbon nanotubes are preferred. For example, the emitters 12 can be formed on a portion or an entirety of the outer surface of the metallic wire 10 by a growth method, coating, electrical plating, electrophoresis, or a deposition method. In addition, the emitters 12 can be formed by coating an adhesive layer on the outer surface of the metallic wire 10, and then adhering the emitters 12 thereon.

Preferably, the cathode filament 20 is bent into a saw-toothed shape, a wavy shape, a screw-thread shape, etc. The bent cathode filament 20 provides more emitters 12 for emitting electrons. The bent cathode filament may be bent into the desired bent shape after or before the formation of emitters 12 on the metallic wire 10. More preferably, the emitters 12 are substantially perpendicular with respect to the outer surface of the metallic wire 10, and extend radially therefrom.

Figure 5:
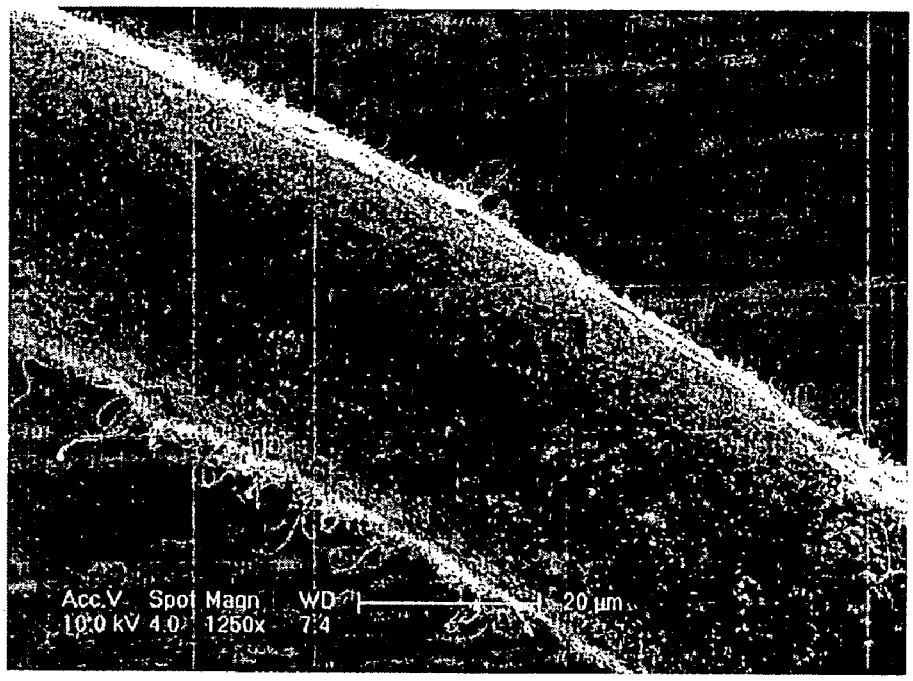
FIG. 5 is an SEM (scanning electron microscope) image of part of a metallic wire having carbon nanotubes formed thereon, according to the first or second preferred embodiments of the present invention.

Referring to FIG. 5, an SEM image of a copper wire having a number of carbon nanotubes formed thereon is shown. The copper wire has a diameter about 50 micrometers. An array of carbon nanotube is deposited on a surface of the copper wire. The copper wire with carbon nanotubes is made by forming a catalyst layer (such as iron) with a thickness about several nanometers on a surface of the copper wire by coating or soaking, and growing carbon nanotubes on the catalyst layer by chemical vapor deposition. The copper wire with carbon nanotubes can be employed as the cathode filament 20 for the field emission lamp.

In use, different voltages are applied to the cathode electrode 54 and the anode electrode 56 respectively. Electrons are drawn from the emitters 12, and bombard the phosphor layer 42 thereby producing visible light. For example, the anode electrode 56 is grounded, and an appropriate negative voltage is applied to the cathode electrode 54, thereby forming a strong field between the cathode filament 20 and the anode layer 44. The strong field induces the emitters 12 on the outer surface of the metallic wire 10 to emit electrons, and the electrons bombard the phosphor layer 42, thereby producing visible light.

Figure 2:
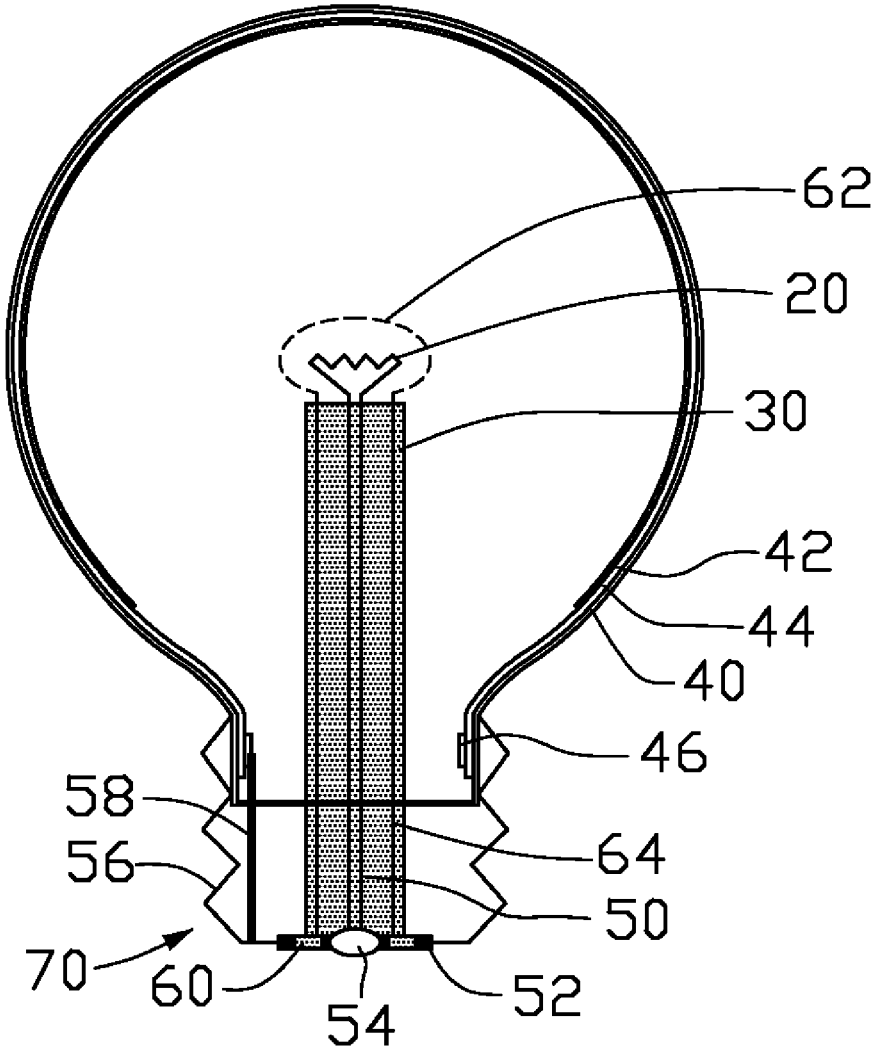
FIG. 2 is a schematic, simplified, cross-sectional view of a fluorescent field emission lamp according to a second preferred embodiment of the present invention.

Referring to FIG. 2, a triode type field emission lamp according to a second preferred embodiment of the present invention is shown. The triode type field emission lamp has substantially the same structure as that of the field emission lamp of the first preferred embodiment, except that an additional gate grid 62 surrounds the cathode filament 20. Furthermore, a gate electrode 60 is located at the lamp head 70. The gate electrode 60 is insulated from both the cathode electrode 54 and the anode electrode 56. The gate grid 62 is electrically connected with the gate electrode 60 via a gate down-lead 64 embedded in the insulating holder 30. The gate grid 62 can be weaved with a metallic wire into a desired shape, which may be spherical, or generally elliptical or curved in cross-section. A number of grid holes is defined in the gate grid 62, for electrons to pass therethrough. In the illustrated embodiment, the gate grid 62 is weaved into a cage structure that is generally elliptical in cross-section. The cathode filament 20 is enclosed in the gate grid 62.

In use, similar to other known kinds of triode type field emission devices, different voltages can be applied to the anode electrode 56, the cathode electrode 54 and the gate electrode 60 respectively. The gate grid 62 facilitates emission of electrons from the emitters 12, lowers an operating voltage, and improves an emission current.

Compared with a conventional lamp, the field emission lamp of any of the above-described embodiments has the following advantages. Firstly, the field emission lamp does not adopt mercury vapor or any other noxious vapor, and thus is safe for humans and environmentally friendly. Secondly, the bulb of the field emission lamp is vacuumized. There is no need for a filling gas, and costs are reduced. Thirdly, the field emission lamp adopts a cold cathode, thereby providing a high electrical energy utilization ratio and low energy consumption.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

We claim:

1. A field emission luminescent light source, comprising:

a bulb being vacuum sealed and having an inner surface;

a lamp head mated with the bulb;

an electron emitting cathode filament positioned in the bulb, the electron emitting cathode filament comprising an one-dimensional metallic wire and a plurality of electron emitters formed on the outer surface of the metallic wire, wherein substantially all the electron emitters extend radially from and are substantially perpendicular to the outer surface of the metallic wire;

an anode layer located on the inner surface of the bulb;

a phosphor layer located on the anode layer;

an anode electrode located at the lamp head and electrically connected with the anode layer;

a cathode electrode located at the lamp head and electrically connected with the electron emitting cathode filament; and a cage shaped gate grid structure surrounding the cathode filament, and a gate electrode located at the lamp head, wherein the cage shaped gate grid structure is electrically connected with the gate electrode, the cage shaped gate grid structure is weaved metallic wire defining a plurality of grid holes therein, the cathode filament is enclosed in the cage shaped gate grid structure.

2. The field emission luminescent light source as claimed in claim 1, wherein the bulb has a bulb center, and the cathode filament is located at the bulb center.

3. The field emission luminescent light source as claimed in claim 1, wherein the cathode filament has a bent shape.

4. The field emission luminescent light source as claimed in claim 3, wherein the cathode filament is sawtooth-shaped, wavy-shaped, or screw-thread shaped.

5. The field emission luminescent light source as claimed in claim 1, wherein the electron emitters comprise any one or more of nanotubes, nanowires, and nanorods.

6. The field emission luminescent light source as claimed in claim 5, wherein the electron emitters comprise carbon nanotubes.

7. The field emission luminescent light source as claimed in claim 1, further comprising an insulating holder fixed at the lamp head, and extending into an inner space of the bulb for supporting the cathode filament.

8. The field emission luminescent light source as claimed in claim 7, wherein a cathode down-lead wire is embedded in the insulating holder, and the cathode down-lead wire has opposite down-lead ends, which are electrically connected with the cathode filament and the cathode electrode respectively.

9. The field emission luminescent light source as claimed in claim 1, further comprising an electrically insulative medium located at the lamp head between the anode electrode and the cathode electrode.

10. The field emission luminescent light source as claimed in claim 1, further comprising an anode down-lead ring and an anode down-lead pole, and wherein the bulb comprises a bulb neck portion, the anode down-lead ring is located at the bulb neck portion, and the anode down-lead ring is engaged with the anode layer and is electrically connected with the anode electrode via the anode down-lead pole.

11. The field emission luminescent light source as claimed in claim 1, further comprising a getter located in the bulb, wherein the bulb comprises a bulb neck portion and the getter is arranged at the bulb neck portion of the bulb.

12. The field emission luminescent light source as claimed in claim 1, the gate electrode is electrically insulated from both the cathode electrode and the anode electrode.

13. The field emission luminescent light source as claimed in claim 1, further comprising an insulating holder fixed at the lamp head and extending into an inner space of the bulb, and a gate down-lead embedded in the insulating holder, wherein the cage shaped gate grid structure is electrically connected with the gate electrode via the gate down-lead.

14. The field emission luminescent light source as claimed in claim 1, wherein the outer surface of the metallic wire is smooth.

15. The field emission luminescent light source as claimed in claim 1, wherein the cage shaped gate grid structure has an elliptical cross-section.

16. The field emission luminescent light source as claimed in claim 1, wherein the cage shaped gate grid structure has a spherical shape.

17. A field emission luminescent light source, comprising:

an electron emitting cathode filament positioned in a bulb, the electron emitting cathode filament comprising an one-dimensional metallic wire and a plurality of electron emitters formed on the outer surface of the metallic wire, wherein substantially all the electron emitters extend radially from and are substantially perpendicular to the outer surface of the metallic wire;

an anode layer;

a phosphor layer located on the anode layer;

an anode electrode electrically connected with the anode layer;

a cathode electrode electrically connected with the electron emitting cathode filament; and a cage shaped gate grid structure enclosing the electron emitting cathode filament, and a gate electrode located at the lamp head, wherein the cage shaped gate grid structure is electrically connected with the gate electrode, and the cage shaped gate grid structure is waved metallic wire defining a plurality of grid holes therein.

18. A field emission luminescent light source, comprising:

a bulb being vacuum sealed and having an inner surface;

a lamp head mated with the bulb;

a sawtooth-shaped electron emitting cathode filament positioned in the bulb, the sawtooth-shaped electron emitting cathode filament comprising a one-dimensional metallic wire and a plurality of electron emitters formed on the outer surface of the one-dimensional metallic wire, wherein substantially all the electron emitters extend radially from and are substantially perpendicular to the outer surface of the one-dimensional metallic wire;

an insulating holder fixed at the lamp head, and extending into an inner space of the bulb for supporting the sawtooth-shaped electron emitting cathode filament;

an anode layer located on the inner surface of the bulb;

a phosphor layer located on the anode layer;

an anode electrode located at the lamp head and electrically connected with the anode layer;

a cathode electrode located at the lamp head and electrically connected with the sawtooth-shaped electron emitting cathode filament, wherein two ends of the sawtooth-shaped electron emitting cathode filament are connected to the cathode electrode via two cathode down-lead wires respectively, and the two cathode down-lead wires are embedded in the insulating holder.

19. The field emission luminescent light source as claimed in claim 18, further comprising a getter located in the bulb, an anode down-lead ring and an anode down-lead pole, wherein the bulb comprises of a bulb main portion and a bulb neck portion on which the lamp head is fixed; the getter is arranged at the bulb neck portion of the bulb; the anode down-lead ring is located at the bulb neck portion; and the anode down-lead ring is engaged with the anode layer and is electrically connected with the anode electrode via the anode down-lead pole.

20. The field emission luminescent light source as claimed in claim 19, further comprising a spherical cage shaped gate grid structure enclosing the cathode filament, a gate electrode located at the lamp head, and a gate down-lead embedded in the insulating holder, wherein the spherical cage shaped gate grid structure is electrically connected with the gate electrode via the gate down-lead, the spherical cage shaped gate grid structure is weaved metallic wire defining a plurality of grid holes therein.

* * * * *